United States Patent [19]

Campos

[11] 4,244,579

[45] Jan. 13, 1981

[54] BOARD GAME

[76] Inventor: Luis B. Campos, 8454 Sharp Ave., Sun Valley, Calif. 91352

[21] Appl. No.: 950,462

[22] Filed: Oct. 11, 1978

[51] Int. Cl.[3] ..... A63F 3/00

[52] U.S. Cl. ..... 273/243; 273/290

[58] Field of Search ..... 273/243, 249, 260, 262, 273/250, 251, 252, 253

[56] References Cited

U.S. PATENT DOCUMENTS

| | | | |
|---|---|---|---|
| 2,194,854 | 3/1940 | Howard | 273/248 |
| 2,780,463 | 2/1957 | Salomon | 273/249 |
| 2,792,227 | 5/1957 | Auerbach | 273/249 |
| 2,990,181 | 6/1961 | Lippold | 273/250 |
| 3,815,919 | 6/1974 | Cain et al. | 273/249 |

*Primary Examiner*—Richard C. Pinkham
*Assistant Examiner*—Scott L. Brown
*Attorney, Agent, or Firm*—Fulwider, Patton, Rieber, Lee & Utecht

[57] ABSTRACT

A strategy game is provided in which two or more people play on a game board by moving pieces along a square spiral path. Movement along the path is determined by dice and by cards. Cards are obtained when a piece lands on appropirate spaces. The object of the game is to score a predetermined number of points. Scoring occurs when a piece captures an opponent's piece by landing on a space occupied by that piece. The score is calculated by adding to the values of the two pieces, values assigned to the space where the capture occurred.

8 Claims, 6 Drawing Figures

Fig. 1
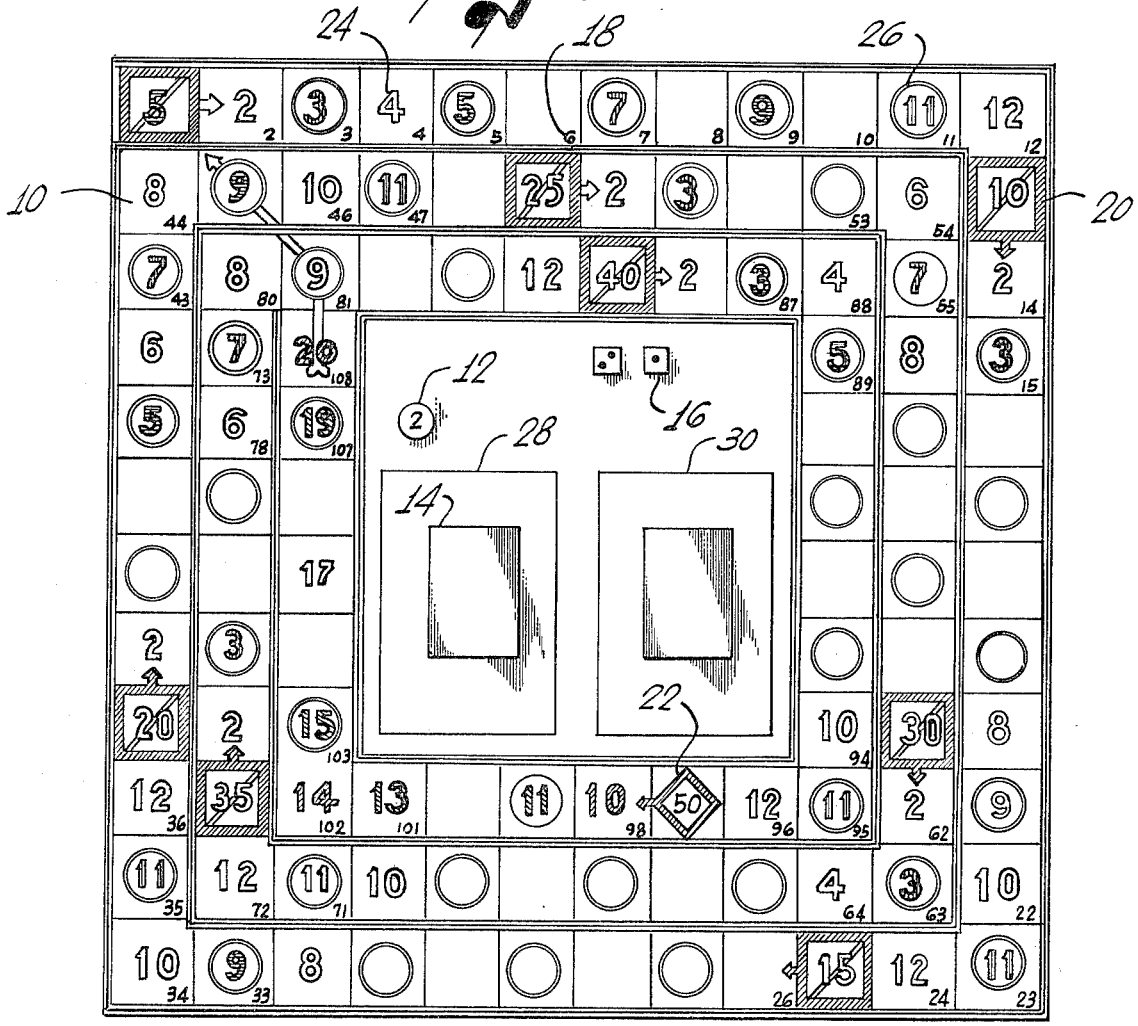
Fig. 2
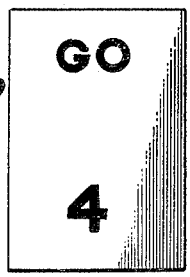
Fig. 3
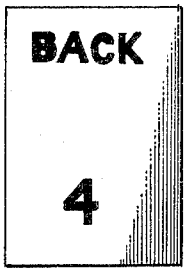
Fig. 4
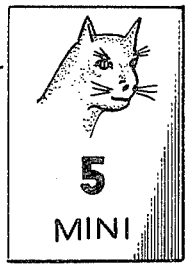
Fig. 5
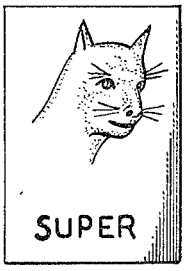
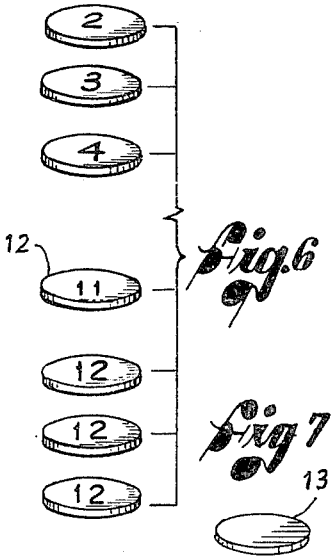
Fig. 6
Fig. 7

BOARD GAME

BACKGROUND AND SUMMARY OF THE INVENTION

While board games are common in the art, this game combines unusual board game features. The object of the game is to win by scoring a predetermined number of points first. A player scores these points by capturing enemy counters and by completing circuits of the board. A player loses points only when he has too many counters in play or when he lands on a space one of his counters already occupies. Counters are moved forward along the circuit of spaces in accordance with throws of the dice and with instructions on cards. The cards, which provide for movement in both the forward and backward direction, can be drawn whenever the player makes certain plays. Movement in the backward direction with cards or certain dice throws is allowed.

BRIEF DESCRIPTION OF THE DRAWINGS

FIG. 1 is a plan view of the game board showing the path on which counters move;

FIGS. 2, 3, 4 and 5 show representative counter movement cards used in playing the game; and FIG. 6 shows the arrangement of a player's counters at the start of the game.

FIG. 7 shows blank counters.

DETAILED DESCRIPTION

In the embodiment shown in FIG. 1, the game apparatus includes a game board 10, sets of movable counters 12, a set of movement-signalling cards 14 and a pair of dice 16. The circuit has one hundred eight playing spaces. Every playing space has in it a small number 18 showing the space's location in the circuit which aids the player in counting spaces. The spaces are arranged in a square spiral path comprised of three revolutions of the spiral. The outermost revolution has twelve spaces on a side, the middle revolution has ten spaces on a side, and the innermost revolution includes only eight spaces on a side. The circuit begins at the upper left corner on the outermost revolution and moves clockwise as viewed in FIG. 1. After all the outside spaces are used, at space 44, the circuit moves along the middle revolution and continues clockwise. The circuit moves to the inward revolution at space eighty. At space one hundred eight, the last space on the innermost revolution, the circuit is complete and the counters continue play moving next to the beginning of the circuit.

The circuit is divided into nine groups of twelve spaces, and each of these groups of twelve spaces will be referred to hereinafter as a lap. Each of the first eight laps is similar. Each lap commences with a space consisting of a rectilinear design and a large numeral 20. This rectilinear pattern has lines parallel to the edges of the space except that the pattern of the last such square 22 which commences the last lap is turned forty-five degrees to form a diamond shape design. The value of the numeral is five for the first lap and increases by five for each succeeding lap. The numeral shows the lap value for the lap. Each of the rest of the spaces in the lap have in their center a large numeral 24 which ranges sequentially from two to twelve. All even numerals are the same color. Every odd numeral is circled 26. The numerals three, seven and eleven are of a color distinct from the color of the even numbers, and the numerals five and nine are a separate third color. The ninth lap commences with a space having a rectalinear design and the numeral fifty. It is followed by spaces with numerals ten through twenty. The second, sixth and tenth space in the lap, spaces ninety-nine, one hundred three and one hundred seven, respectively, are in a contrasting color and are encircled.

In the board area inside the circuit are located first and second boxes 28 and 30 for the storage of cards 14 to be drawn and discarded. The first box 28 holds randomly ordered cards yet to be drawn, and the second box 30 holds discarded cards.

The cards used in the game are rectangular with instructions printed on one side. There are sixty-three cards in the present embodiment. Thirty-eight cards read "GO" and a number and can be used to advance a counter the number of spaces shown. In the present embodiment there are two each of the GO cards with numbers 1, 3, 5, 7, 9, 11, 15, 18, 21 and 24 and three each of 2, 4, 6, 8, 10 and 12. Twelve cards read BACK and a number and can be used to move the counter backwards. There is one BACK card for each number from one to twelve. There are twelve cards showing a cat's head, the word MINI and each of the integers from one to twelve. There is one card showing a cat's head and the word SUPER.

The game includes identifiable sets of counters 12 for each player. Each set includes thirteen valued counters, three counters valued at twelve, one counter each of the values from two through eleven, and a multiplicity of blank counters 13 which can be engaged with the valued counters to form a new unit. Each valued counter has its intrinsic value displayed on it.

The rules for playing the present game are as follows: players arrange their thirteen counters in a stack in ascending value. Counters two through eleven are atop the three counters valued at twelve. High score on single die throw establishes which player will start the game. Play moves around the board in a clockwise direction beginning at square number one. The first player throws two dice for his first play and other players then follow in rotation. On his first play, each player brings on his counter valued two to the space whose value is indicated by the dice throw.

Whenever a counter lands on spaces with square values of three, seven or eleven, the player may take a card from the card stack and must display the card to the other players. A player is also entitled to draw a card from the card stack whenever that player throws two dice and the dice both show the same number, sometimes called throwing a pair or doubles. However, a player moving backward as a penalty who lands on a space with a squared value of three, seven or eleven, or who throws a pair during a penalty is not entitled to draw a card. A player is entitled to draw a card, in addition to any other cards he is entitled to draw, when one of the player's counters captures an enemy.

If the card drawn is a MINI card, the player may move his counter furthest advanced in the circuit or circuits, forward or backward the number of spaces designated by the number on the card. The player is not forced to play the MiNI card immediately, but can hold it for use in a future play. The player may combine two or more MINI cards, as well as any GO or BACK cards he may possess, for use in a single play. If the card drawn is a SUPER card, the player must immediately move his counter, furthest advanced in the circuit or circuits, which is not resting in the last lap, any number of spaces between one and twelve in the forward or reverse direction. If the card is a GO or BACK card, the card may be played or kept face up for later use. GO and BACK cards may be used in combination with other GO and BACK cards to yield a single move which is the algebraic total of the directions on the cards used in combination. However, when a player draws a SUPER card, all other players must surrender any cards they are holding, and all such cards are then shuffled, together with the SUPER card, and replaced in the card stack from which cards are drawn.

Whenever a counter lands on the space with a square value of five or nine, the player has the option during any of his plays of making an additional throw of one die and then moving that counter forward or backward the amount shown on the die. This option, called floating, applies only as long as that counter remains on said five or nine space and applies only to the counter on said space. If the player has more than one counter which can float, the player is entitled to throw a single die as many times as there are counters capable of floating. The player may move any of said counters after any die throw without specifying in advance which counter will be moved.

Whenever a player's dice throw results in throwing a pair, the player must bring into play the next counter in his stack of counters. There is an exception to this rule: where a player could advance another counter by the number on the dice and in so doing capture an enemy counter or could by combining the dice number with a card or cards held move and capture and enemy counter, the capturing move may be made in lieu of bringing a counter into play.

Among the various penalties a player may encounter in the game is the penalty of being required to move one's counter backwards. When a counter lands on the first square in a lap, the player, unless he has GO or BACK cards which he can use for an immediate move, must throw both dice and move said counter back the sum shown on the dice. If a pair is thrown or if there is an enemy counter on the space to which the counter is to be moved, the player must temporarily move to the indicated space and then throw the dice again and move the counter back from the temporary space an additional amount as shown by the dice sum. A player whose counter is moving backward as a penalty is not entitled to draw a card when his counter lands on spaces with a square value of three, seven or eleven, or when he throws a pair. Further, the counter cannot act as a floater if it alights on a space which has a square value of five or nine.

In certain instances, a player may forfeit a counter. Forfeiture differs from capture in that a counter forfeited may not be returned to the player's stack of counters. A forfeited counter may not be played again. When forfeiture occurs, the value of the counter at the time of forfeiture is deducted from the player's score. A player forfeits the moving counter when, while it is moving backward as a penalty, it lands on a space already occupied by another counter belonging to that player. A counter on its first circuit must be forfeited if when it is moving backwards under penalty it would be required to move back of space number two. When a particular counter is required to be moved, such as a new counter coming into play upon throw of doubles, and when the space to which it must be moved is occupied by another counter belonging to that player, the moving counter is forfeited. However, if the player can, by moving another counter forward the amount shown on the dice, capture an enemy counter, that capturing move may be made rather than the move which will cause a forfeiture.

Scoring occurs when an enemy counter is captured by another counter moving onto the same space. The captured enemy counter is returned to its player who must place it on the bottom of his stack of counters. The player whose counter effected the capture receives the sum of: the value of his capturing counter; the value of the captured counter; the value of the space where capture occurred, called the square value, the lap value of the capture space, and a bonus of thirty points if the capturing counter, the captured counter and the capture space have identical values. The score received is double the sum computed when the capturing counter is moving backwards or is making its move onto the first lap from off of the board. Should a capture occur on square ninety-seven an additional fifty points are scored.

Special rules apply to the last lap, spaces ninety-eight to one hundred eight. To enter this lap the counter must land on space ninety-seven. This can be done by any of the normal ways of movement.

A player with a counter or counters in the last lap is allowed during each turn, in addition to his regular throw of two dice, to throw a single die once for each of his counters on squares ninety-seven to one hundred eight. When a player has only one counter in play, and that counter is in the penultimate lap, the player may use his throw to either play his counter or bring into play another counter in accordance with the dice throw. A player whose only counter in play is in the last lap is entitled to throw two dice to bring into play another counter and then throw one die to move the counter in the last lap. The player may move his counter or any one of his counters within the last lap forward or backward the amount shown on the die.

A counter on square ninety-seven can go backward with cards. But a counter on square ninety-seven or in the last lap can go forward only by the throw of one die. Further, a counter on squares ninety-eight through one hundred eight can go backward or forward only by die throw, not by cards. For a counter landing in the last lap on the squares with circled numerals, the player is entitled to another movement in accordance with the throw of a single die.

Counters advancing out of the last lap pass back into the first lap in continuous movement because square number one is treated as being adjacent to square one hundred eight. Should the counter leave the last lap and land on square one, the player must immediately throw a single die and make a penalty move backwards into the last lap.

Upon reaching square number two, the counter is "capped" by having stackably engaged to it a blank counter of the same color. A counter is capped each time it passes out of the last lap and, thus, it may be composed of the original token and a number of blanks. Each blank increases the counter's value an amount equivalent to the counter's initial value. When a capped counter captures another piece, an additional fifty points for each blank token the counter has is added to the score. For example, when a capturing counter has two blank tokens, an additional one hundred points are added.

The counter's total capped value is used in computing all scoring and is used for determining whether the counter qualifies for capture scoring bonuses and board plays which arise according to the counter's value. The token coming out onto the first lap also receives a circuit score for completing one circuit of the board. The score is fifty points times the number of circuits that counter has completed. Should the counter be penalized back into the last lap, the circuit score is deducted but the counter can recover the score when it again comes out onto the first lap.

A player must have a minimum of three counters at play on the board between squares number two and number ninety-six before he can advance any of his counters with the throw of both dice. A player may use GO, BACK, SUPER and MINi cards to move this counters, even if he has less than three counters at play within squares number two and number ninety-six.

A player is allowed to have a maximum of six counters on the board at one time. If a player has more than six counters in play and that fact is announced by another player, at the moment of the announcement the player who has an excess number of counters forfeits the counter or counters with the highest value (instrinsic values and any caps) until only six counters remain in play. A penalty of fifty points for each counter in excess of 6 is deducted from the player's score. If the player who has more than six counters in play notices his error before an opponent does, he may retrieve from the board the excess counter or counters removing first the counter with the highest intrinsic value without incurring the fifty point penalty or forfeiting the counters in excess. The counter or counters which the player removes are placed at the bottom of the players stack in the same manner as are captured counters.

Whenever a player forfeits a counter because it must be moved to a space occupied by another counter of the same player, the moving counter, not the stationary counter, is forfeited.

The player may play any option available to him in any order. However, any option arising from the throw of two dice must be played immediately after that throw. When the player has more than one counter which can be moved with the throw of one die, such a counter being on a space whose square value is five or nine or a counter in the last lap, the player may throw one die without specifying in advance which piece he intends to play.

I claim:

1. In a game apparatus, which can be played by at least two players the combination of:

a game board having a continuous path comprising a continuous circuit having a plurality of playing spaces, said playing spaces being arranged into laps, all of said laps in said circuit having the same number of spaces, and wherein the board is square shaped and has on it an involuted circuit rectangularly disposed consisting of nine laps of twelve spaces each, each of said spaces on said board having a space value indicated by a number, said numbers running consecutively through said circuit, a first eight laps each lap beginning with a multicolored square space containing a bonus number, each of said bonus numbers being unique to a given lap and also being the lap value attached each of said spaces in said lap, each of said spaces following said bonus number having in its center an integer, said intergers running consecutively in said eleven spaces from two to twelve, integers three, five, seven, nine and eleven being encircled, a last lap having spaces with the integers running consecutively from ten to twenty rather than two to twelve, integers fifteen and nineteen are encircled, said board also having fixed locations for the storage of cards to be drawn and cards drawn;

a plurality of counters, each counter having an intrinsic value, said counters being grouped into a plurality of sets of counters, each of said sets being identical in composition to each other set;

means for signalling the direction and number of spaces which a counter may move; and means for increasing said intrinsic value of each of said counters.

2. A board apparatus as in claim 1 wherein said means for signalling are dice and movement indicating cards.

3. A game apparatus as in claim 2 wherein said integers in said spaces have distinctive colors, each of said integers showing three, seven and eleven being a first color, each of said integers showing five and nine being a second color different from said first color, each of said integers showing even numbers being a third color different from said first and second colors, and said integers in the last lap showing eleven, fifteen and nineteen being a fourth color different from said first, second and third colors.

4. A board game apparatus as in claim 2 wherein said movement indicating cards include GO cards, BACK cards, MINI cards and SUPER cards.

5. A board game apparatus as in claim 4 wherein:

said GO cards include cards bearing the word GO and the numerals from the set including 1, 2, 3, 4, 5, 6, 7, 8, 9, 10, 11, 12, 15 18, 21 and 24;

said BACK cards include cards bearing the word BACK and the numerals from the set including 1, 2, 3, 4, 5, 6, 7, 8, 9, 10, 11, 12;

said MINI cards include cards bearing the word MINI, a cat's head and the numerals from the set including 1, 2, 3, 4, 5, 6, 7, 8, 9, 10, 11, 12; and said SUPER card bears the word SUPER and a cat's head.

6. A board game apparatus as in claim 5 wherein:

said set of GO cards comprises, two cards each having the numerals 1, 3, 5, 7, 9, 11, 15, 18, 21 and 24, three cards each having the numerals 2, 4, 6, 8, 10 and 12; and said set of BACK cards comprises one card each having the numerals 1, 2, 3, 4, 5, 6, 7, 8, 9, 10, 11, 12.

7. A board game apparatus as in claim 2, wherein the number of said counters in play upon said board is less than seven.

8. A board game apparatus comprising:

a plurality of counters arranged into sets, each set comprising three counters valued at thirteen, one counter for each integral value between and including two and twelve, and a plurality of blank counters;

a game board having a continuous path comprising a circuit composed of a plurality of laps each lap having a plurality of playing spaces said laps being joined end to end so that said counters move continuously from one lap to the next lap, each of said laps beginning with a square having a bonus number, said bonus number being unique to a given lap, each of said spaces in said lap following said square having in its center an integer bonus number, said integers in said spaces running consecutively from two to twelve, said integers being systematically colored;

a pair of dice a set of cards including,

GO cards bearing the word GO and the numerals 1, 2, 3, 4, 5, 6, 7, 8, 9, 10, 11, 12, 15, 18, 21 and 24;

BACK cards bearing the word BACK and the numerals from the set including 1, 2, 3, 4, 5, 6, 7, 8, 9, 10, 11, 12;

MINI cards bearing the word MINI, a cat's head and the numerals from the set including 1, 2, 3, 4, 5, 6, 7, 8, 9, 10, 11, 12, and a SUPER card bearing the word SUPER and a cat's head.

* * * * *